United States Patent [19]

Gregoire

[11] Patent Number: 4,801,120

[45] Date of Patent: Jan. 31, 1989

[54] READING APPARATUS

[76] Inventor: Renaud Gregoire, 3374 Lambert Closse Street, Sainte-Foy, Canada, G1W 2S4

[21] Appl. No.: 194,999

[22] Filed: May 17, 1988

[51] Int. Cl.[4] ..... A47B 19/00

[52] U.S. Cl. ..... 248/441.1; 248/447; 248/458

[58] Field of Search ..... 248/441, 442.2, 447, 248/458, 446, 448, 449, 460, 447.2, 415, 121, 289.1, 297.3, 295; 403/339, 381, 331

[56] References Cited

U.S. PATENT DOCUMENTS

| | | | |
|---|---|---|---|
| 1,228,083 | 5/1917 | Warfel | 248/442.2 X |
| 1,983,981 | 12/1934 | Hanson | 248/458 |
| 2,044,589 | 6/1936 | Morgan et al. . | |
| 2,235,367 | 3/1941 | Heausler . | |
| 2,236,133 | 3/1941 | Croninger et al. . | |
| 2,422,877 | 6/1947 | Anderson . | |
| 2,638,701 | 3/1953 | Dahlgren . | |
| 2,691,239 | 10/1954 | McCollum . | |
| 4,249,336 | 2/1981 | Moe et al. . | |
| 4,327,889 | 3/1982 | Zaplotnik . | |
| 4,568,052 | 2/1986 | Solomon et al. | 248/447 X |

FOREIGN PATENT DOCUMENTS

| | | |
|---|---|---|
| 150536 | of 1913 | Canada . |
| 339755 | 3/1934 | Canada . |

*Primary Examiner*—Ramon O. Ramirez

[57] ABSTRACT

The apparatus comprises a post having a floor-engaging base, an arm having its rear end pivotally connected to the top of said post for horizontal swinging movement, a connector pivoted to the front end of the arm for rotation about a vertical axis, said connector defining a rearwardly- upwardly-inclined plate-like element having upwardly-converging side edges which are also rearwardly converging thicknesswise of the plate-like element. A reading material support plate, having a bottom ledge, is provided at its back face with a pair of flat, elongated retainer elements which define between themselves a series of cavities with upwardly-converging side edges, which are also rearwardly converging thicknesswise for mating with and selectively receiving the plate-like element of the connector. It is a simple matter to insert the plate-like element in a selected cavity. The support plate is thus supported at a selected level and prevented from detachment from the connector. The apparatus is more particularly adapted to support a book or the like in reading position for a person seated in a chair.

6 Claims, 4 Drawing Sheets

FIG. 9
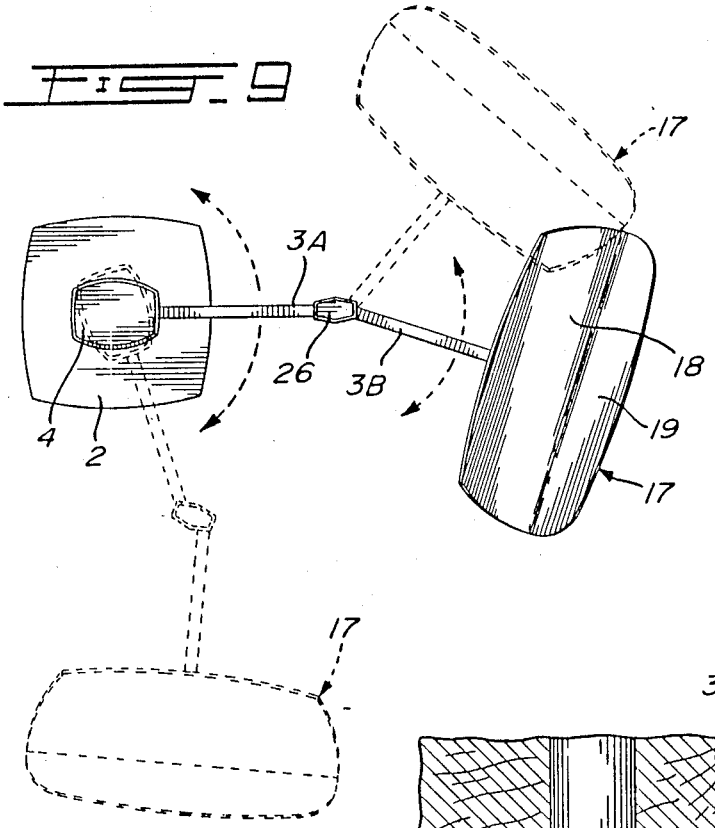
FIG. 7
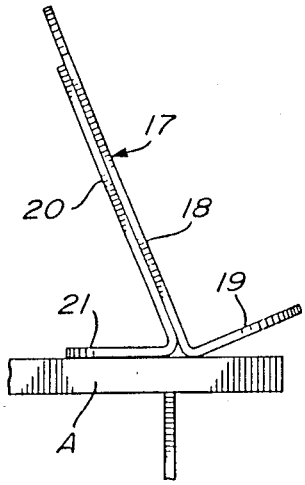
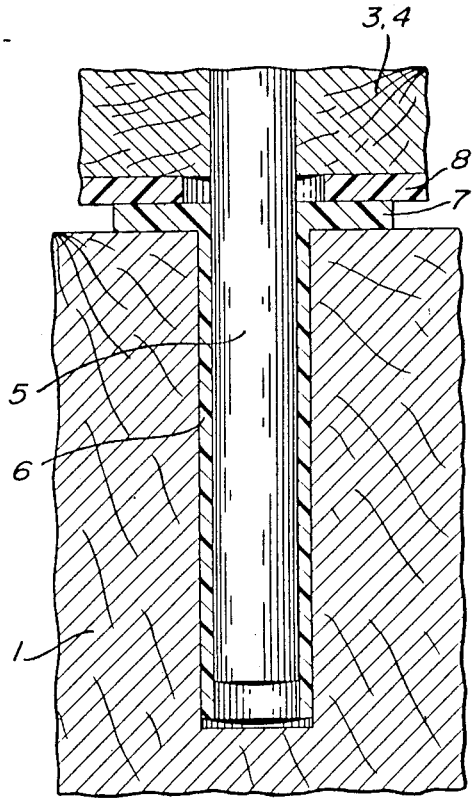
FIG. 6

READING APPARATUS

FIELD OF THE INVENTION

The present invention relates to a reading apparatus and, more specifically, to an orientable support for conveniently supporting a book or the like reading material in a position easily accessible to a reader in a chair, a bed or the like.

BACKGROUND OF THE INVENTION

It is known to provide a reading apparatus comprising a post, an arm horizontally swingable at the top portion of the post and a support plate with a bottom ledge for supporting reading material, the supporting plate being connected to the front end of the arm for horizontal orientation and also for level adjustment. However, in the prior art, the level adjustment means are complicated in construction, difficult to handle and, generally, do not permit detachment of the support plate from the arm. Examples of prior art devices are as follows: U.S. Pat. No. 2,236,133 dated Mar. 25, 1941, issued to Arthur G. Kroninger et al and entitled: "COPY HOLDER" and Canadian Patent No. 339,795 dated Mar. 6, 1934, entitled: "BOOK HOLDERS" and inventor Daniel Busby. In the American patent, the support frame is not easily detachable from the arm and a knurled knob, only accesible at the back of the support plate, must be manipulated to adjust the level of the support plate. In the Canadian patent, wing nuts high above the level of the book holder proper must be manipulated to adjust the book holder level and, moreover, the entire reading apparatus is cumbersome and inaesthetic.

OBJECTS OF THE INVENTION

It is the main object of the present invention to provide a reading apparatus which is of very simple construction, having good aesthetic appeal and in which the book support plate can be easily level adjusted and detached from its supporting arm by a simple manipulation of the support plate itself, without having to reach specific parts behind the same or above the same.

SUMMARY OF THE INVENTION

The reading apparatus comprises a post, an arm having a rear end pivotally connected to an upper portion of the post for substantially horizontal swinging movement about the longitudinal axis of the post, the arm having a front end, a connector pivoted to the front end of said arm for rotation of said connector relative to said arm about a second axis substantially parallel to said longitudinal axis, said connector defining a plate-like element which is rearwardly, upwardly inclined relative to said second axis and which has upwardly-converging side edges, a support for reading material including a support plate having a front face and a back face, a top edge and a bottom edge, a ledge protruding from said bottom edge at said front face, a series of superposed cavities formed at said back face extending between said top and bottom edges, each cavity having upwardly-converging sides for selectively mating with the coverging sides of said plate-like elements, whereby said plate-like elements, when inserted in any selected cavity, will support said support plate at a selected level, and further including retainer means at each cavity engageable with said connector to releasably prevent detachment of said support from said connector.

Preferably, the converging side edges of said plate-like element are also rearwardly, inwardly converging thicknesswise of the plate-like element and said retainer means are formed by the upwardly-converging sides of said cavities, also converging thicknesswise away from the rear face of said support plate. Preferably, the cavities are formed by means of two elongated retainer elements fixed to and rearwardly protruding from the rear face of said support plate and transversely spaced from each other and having a series of inward side edge portions which define the sides of said cavities. Preferably, each inclined side edge portion is separated from an adjacent side edge portion by a horizontal step, each step spaced downwardly from the bottom edge of said plate-like element when the latter is inserted in a cavity, so as to permit release of the same plate element from a selected cavity by simple upward movement of the support with respect to the connector. Preferably, each retainer element has at its lower end a rearwardly-extending foot extension to permit resting of the support plate on a flat surface and detached from said connector element.

BRIEF DESCRIPTION OF THE DRAWINGS

FIG. 6 is a vertical section of the pivotal connection of the horizontal arm to the top end of the post;

FIG. 7 is a side elevation showing how the support plate can be stood on a table or the like surface;

FIG. 9 is a top plan view of a reading apparatus provided with the sectional arm of FIG. 8.

DETAILED DESCRIPTION OF THE TWO PREFERRED EMBODIMENTS

Figures 1, 8:
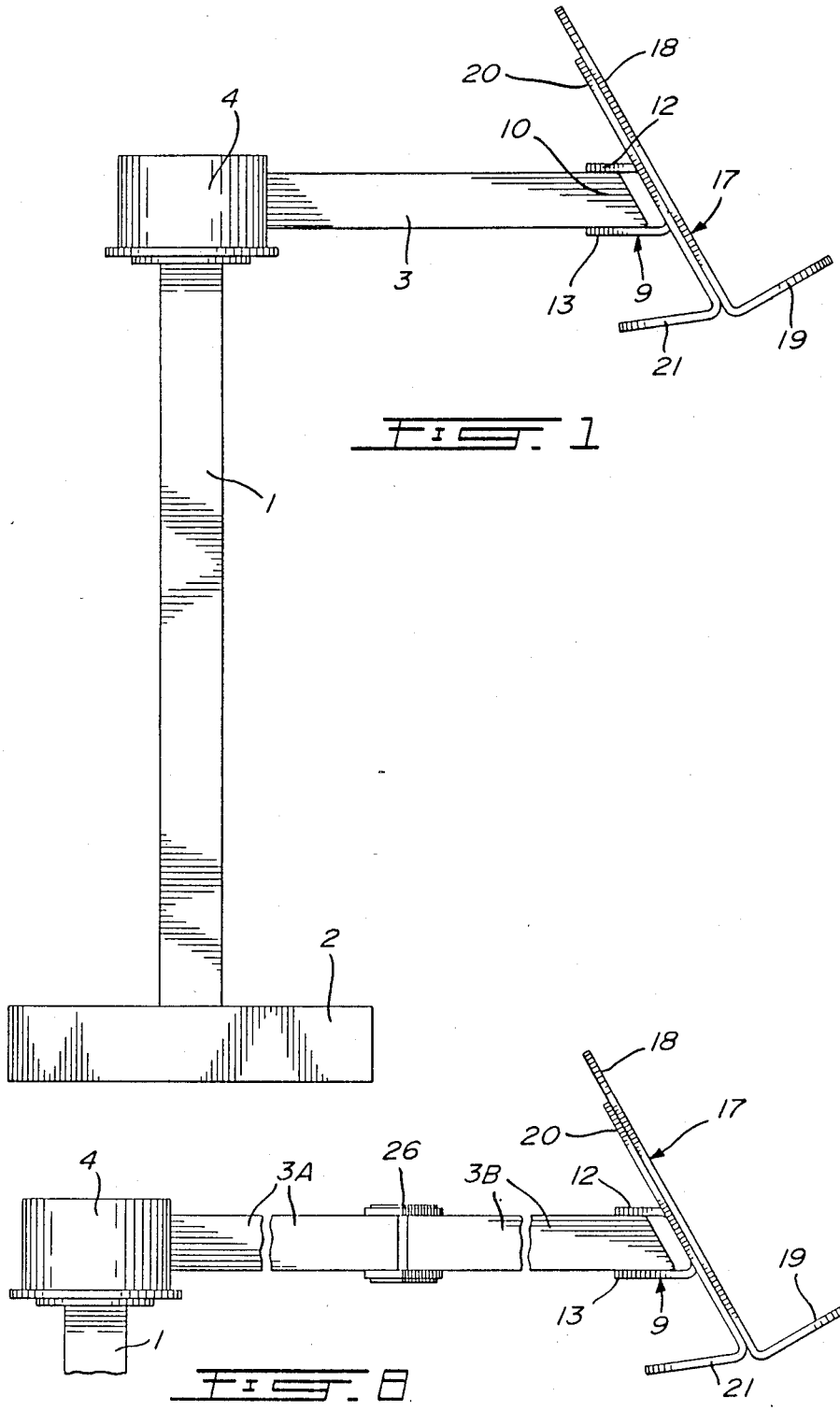
FIG. 1 is a side elevation of the reading apparatus.
FIG. 8, shown on the first sheet of drawings, is a partial side elevation showing another embodiment of the horizontal arm.

The reading apparatus in accordance with the first embodiment includes a post 1 secured at its lower end to a suitably-weighted base 2 adapted to rest on a floor. A horizontal arm 3 is supported by the top end of post 1 for horizontal swinging movement. More particularly, as shown in FIGS. 1 and 6, the rear end of the arm 3 forms an enlargement 4 in which is fixed a vertical pivot pin 5 extending downwardly and engaging a vertical bore in the top end of post 1. Preferably, the bore receiving the pivot pin is lined with a plastic bushing 6 to permit free rotation, and this bushing 6 has a top flange 7 in sliding contact with a plastic covering 8 at the underside of the enlargement 4. Therefore, free rotation of the arm 3 is obtained, and the arm 3 can be pulled out of the top of the post 1, whenever desired. Base 2 and enlargement 4 can have any aesthetic shape.

Figure 3:
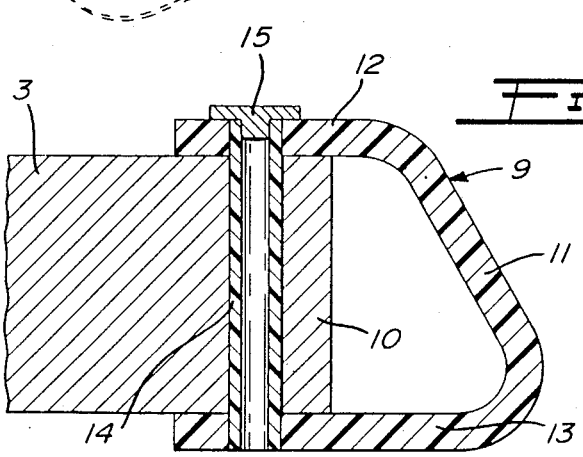
FIG. 3 is a vertical section of the connector element showing its connection to the front end of the horizontal arm.
Figure 4:
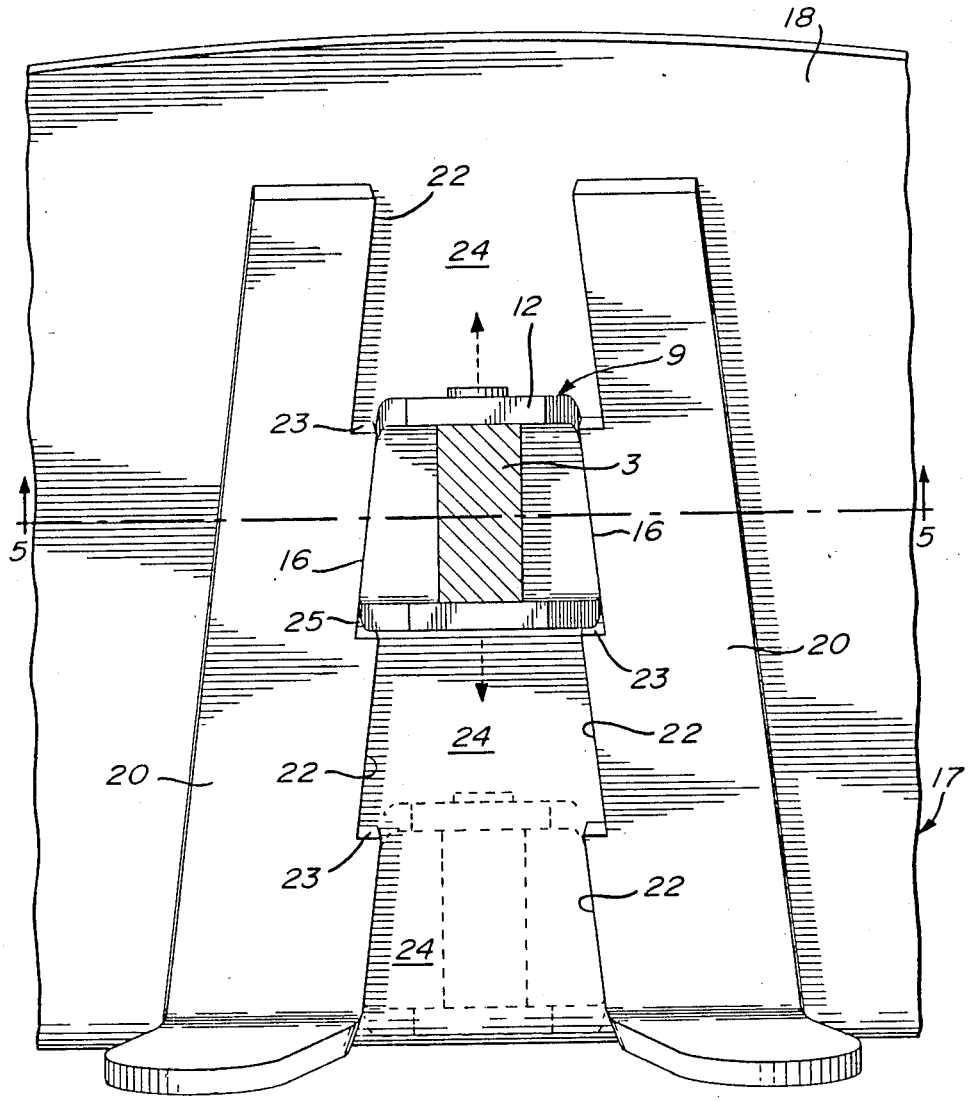
FIG. 4 is a back elevation of the central part of the support plate and showing the connector element in inserted position within a cavity and also showing the horizontal arm in cross-section.
Figure 5:
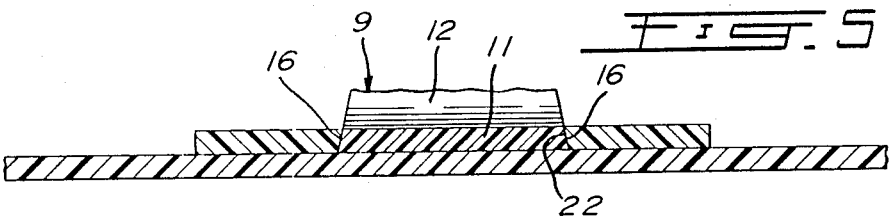
FIG. 5 is a partial section, taken along line 5—5 of FIG. 4.

A connector element 9 is pivotally connected to the front end portion 10 of arm 3 for rotation about an axis parallel to the longitudinal axis of post 1. More particularly, as shown in FIGS. 3, 4, and 5, the connector 9 is formed of a plastic sheet bent into a generally U-shape element and defining a bight 11, a top leg 12 and a bottom leg 13. The spacing between the two legs 12 and 13 is such that these legs will slidably overlap the top and bottom faces of the front end portion 10 of arm 3, respectively. A plastic tube 14 is inserted through a transverse bore of arm 3 and through registering holes in legs 12 and 13 to act as a vertical pivot for the connector. A cap 15 is fitted to the top end of tube 14. The bight 11 is inclined with respect to the legs 12 and 13 in such a manner that the bight extends upwardly and rearwardly of the arm when the connector is attached to this arm and is aligned therewith.

In accordance with the invention, the two side edges 16 of the bight 11, which is in the form of a plate-like element, are upwardly converging at substantially an equal angle, as shown in FIG. 4, and these sides 16 are also rearwardly, inwardly converging thicknesswise of the plate-like bight 11, as clearly shown in FIG. 5.

A support 17 for reading material is provided and comprises a plate 18, preferably made of a plastic sheet which is bent at its lower edge to form a forwardly-projecting ledge 19 protruding from the front face of the plate 18. A pair of retainer elements 20, also preferably made of plastic sheet, are glued or otherwise secured to the back face of plate 18. These retainer elements 20 extend between the top edge and the bottom edge of the plate 18 in spaced relationship transversely of plate 18. The bottom ends of the retainer elements 20 are bent to form rearwardly-extending extensions 21 at about the level of the lower edge of plate 18. These extensions 21 form an acute angle with respect to plate 18. Therefore, as shown in FIG. 7, the support 17 can be stood on a table A, detached from the connector 9, serving to support reading material positioned on ledge 19 against the front face of the plate 18.

Referring to FIG. 4, the inner sides of the two retainer elements 20 each form a series of inward side edge portions 22 separated from each other by a transverse step 23. Each pair of transverly-registering side edge portions 22 are upwardly converging at the same angle, so as to form, with the back face of plate 18, a generally trapezoidal shape cavity 24 for mating with and selectively receiving the plate-like bight element 11. Furthermore, each pair of registering edge portions 22 are rearwardly converging thicknesswise of the retainer elements 20, as clearly shown in FIG. 5.

When bight 11 is inserted in a selected cavity 24, the sides 16 of bight 11 mate with the selected side edge portions 22 of the retainer elements 20, both longitudinally and transversely of these sides 16 and side edge portions 22. In this manner, not only is the support 17 maintained at an adjusted level but the support is retained against detachment from the connector 9.

As shown in FIG. 4, with connector 9 operatively inserted in a selected 24, there is left a space 25 between the bottom of the connector 9 and the step 23, so as to permit insertion and removal of the bight 11 into and from the selected cavity 24.

From the foregoing, it is seen that it is a simple matter to detach the support 17 from the connector 9. The support 17 is simply lifted until the bottom of the connector abuts the two steps 23 of the cavity 24, so as to clear the sides 16 of the bight 11 from the side edge portions 22, and then the support 17 is just pulled forwardly from connector 9. To connect the support 17 to the connector 19, it is a simple matter to press the back face of support 17 against the bight 11 at the generally required level and to feel abutment of the lower edge of the connector 9 against the steps 23 of the selected cavity 24. The back face of plate 18 is then brought into contact with bight 11 and the plate 18 allowed to drop until engagement of the connector sides 16 with the side edge portions 22.

Figure 2:
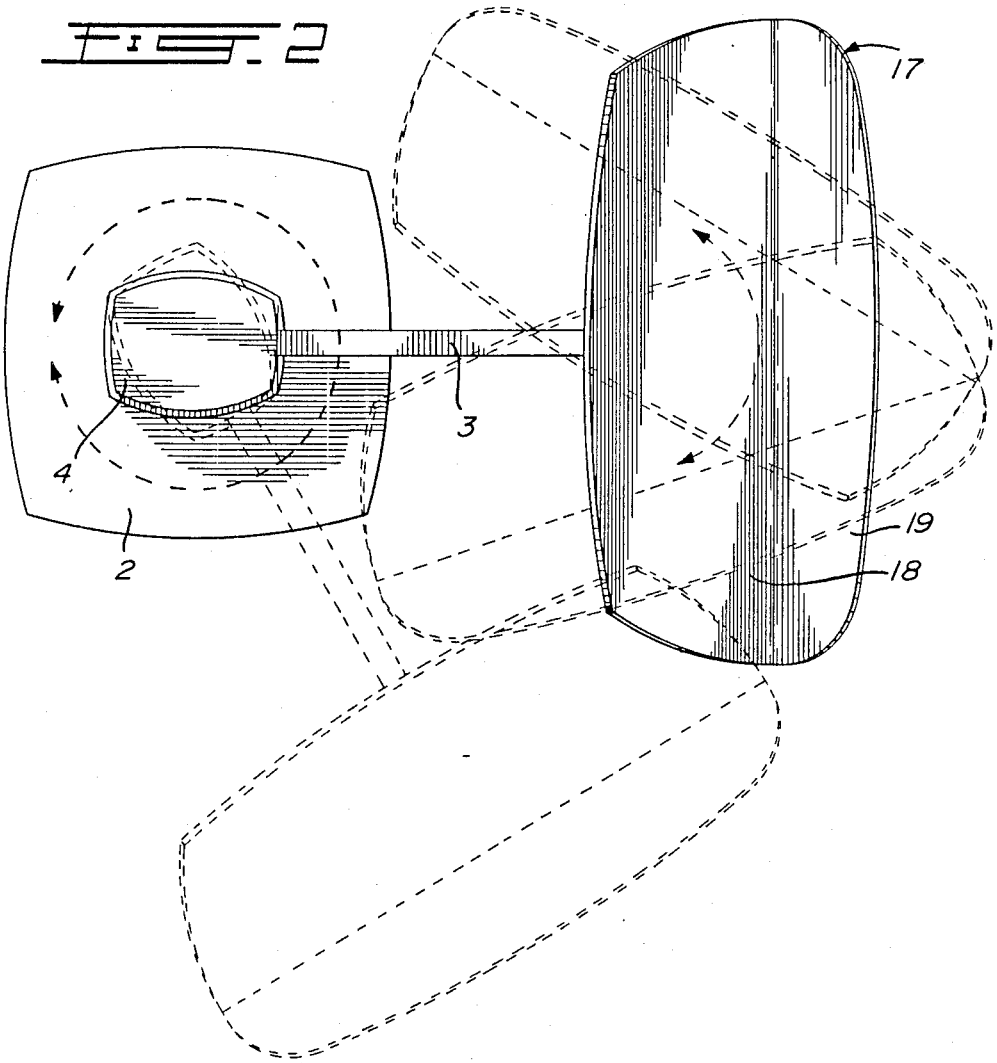
FIG. 2 is a top plan view of the same, also showing in dotted lines various horizontal orientations of the support plate.

The post 1 can be positioned beside a chair and the support 17, once at the selected, adjusted level, can be horizontally oriented, as shown in FIG. 2, to suit the reader seated on the chair.

FIGS. 8 and 9 show an embodiment where there is still more flexibility in the orientation and positioning of the support 17 with respect to the reader. In this second embodiment, the arm 3 is made of two sections 3A and 3B interconnected together by a pivot arrangement 26. Otherwise the other features of the second embodiment are the same as in the first embodiment.

What I claim is:

1. A reading apparatus comprising a post, an arm having a rear end pivotally connected to an upper portion of said post for substantially horizontal swinging movement about the longitudinal axis of said post, said arm having a front end, a connector pivoted to the front end of said arm for rotation of said connector relative to said arm about a second axis substantially parallel to said longitudinal axis, said connector defining a plate-like element rearwardly upwardly inclined relative to said second axis and having upwardly-converging side edges, and a support for reading material including a support plate having a front face and a back face, a top edge and a bottom edge, a ledge protruding from said bottom edge at said front face, a series of superposed cavities formed at said back face, extending between said top and bottom edges, each cavity having upwardly-converging sides for selectively mating with the converging sides of said plate-like element whereby said plate-like element, when inserted in a selected cavity, will support said support plate at a selected level, and further including retainer means at each cavity engageable with said connector to releasably prevent detachment of said support from said connector.

2. A reading apparatus as defined in claim 1, wherein said cavities are defined by a pair of flat, elongated retainer elements fixed to and rearwardly protruding from said rear face of said support plate, extending between said top and bottom edges and transversely spaced from each other, each retainer element having a series of inward side portions which define the sides of said cavities.

3. A reading apparatus as defined in claim 2, wherein said upwardly-converging side edges of said plate-like element are also rearwardly converging thicknesswise of said plate-like element; and wherein said retainer means are formed by said inward side edge portions of said retainer elements converging thicknesswise away from said rear face and selectively mating with said plate-like element.

4. A reading apparatus as defined in claim 3, wherein each said retainer element has an integral bottom extension extending rearwardly from said support plate at substantially the level of said ledge and forming an acute angle with said back face to stand said support on a horizontal surface with said support plate rearwardly, upwardly inclined.

5. A reading apparatus as defined in claim 4, wherein said arm comprises at least two sections pivotally interconnected intermediate said front and said rear end of said arm, about a pivotal axis which is substantially parallel to said longitudinal axis.

6. A reading apparatus as defined in claim 4, wherein each inward side edge portion of each retainer element is separated from an adjacent inward side edge portion by a transverse step, each step spaced downwardly from the bottom of said plate-like element when said plate-like element is inserted in operative position within a selected cavity, so that said plate-like element can be removed from said selected cavity by first upward movement of said support plate relative to said connector and then frontward movement of said support plate relative to said connector.

* * * * *